US006397975B1

(12) United States Patent
Rütten

(10) Patent No.: US 6,397,975 B1
(45) Date of Patent: Jun. 4, 2002

(54) ELEVATOR INSTALLATION WITH A DRIVE UNIT LOCATED IN AN ELEVATOR HOISTWAY

(75) Inventor: Klaus Rütten, Aachen (DE)

(73) Assignee: Inventio AG, Hergiswil (DE)

( * ) Notice: Subject to any disclaimer, the term of this patent is extended or adjusted under 35 U.S.C. 154(b) by 0 days.

(21) Appl. No.: 09/642,869

(22) Filed: Aug. 21, 2000

(30) Foreign Application Priority Data

Aug. 19, 1999 (EP) ..... 99810745

(51) Int. Cl.[7] ..... B66B 11/08
(52) U.S. Cl. ..... 187/266; 187/404
(58) Field of Search ..... 187/404, 254, 187/266, 289, 256, 413, 414

(56) References Cited

U.S. PATENT DOCUMENTS

| | | | | |
|---|---|---|---|---|
| 5,469,937 A | * | 11/1995 | Hakala et al. | 187/266 |
| 5,533,595 A | * | 7/1996 | Narumi et al. | 187/266 |
| 5,906,251 A | * | 5/1999 | Aulanko et al. | 187/254 |
| 6,006,865 A | * | 12/1999 | Ammon | 187/266 |
| 6,148,962 A | * | 11/2000 | Hakala et al. | 187/254 |
| 6,247,557 B1 | * | 6/2001 | Kobayashi et al. | 187/266 |

FOREIGN PATENT DOCUMENTS

| | | | |
|---|---|---|---|
| DE | 298 04 923 U1 | | 7/1998 |
| DE | 298 06 526 U1 | | 9/1998 |
| DE | 197 12 646 A1 | | 10/1998 |
| DE | 197 52 232 A1 | | 5/1999 |
| DE | 197 51 381 A1 | | 6/1999 |
| EP | 0 688 735 A3 | | 12/1995 |
| EP | 0 719 724 A1 | | 7/1996 |
| EP | 0 841 283 A1 | | 5/1998 |
| FR | 2 773 143 | | 7/1999 |
| JP | 2000-344450 | * | 12/2000 |

* cited by examiner

*Primary Examiner*—Jonathan Salata
(74) *Attorney, Agent, or Firm*—Cohen, Pontani, Lieberman & Pavane

(57) ABSTRACT

In an elevator installation based on the rucksack principle the elevator car is suspended laterally. The elevator car is supported by a car frame which is guided on the car guiderails and suspended on the suspension rope. The drive unit is located partly in a first wall niche and partly on a support. A traction sheave of the drive unit projects into the elevator hoistway. The elevator car is connected to the counterweight by the suspension rope which is guided over the traction sheave and deflector sheaves. Located above the drive unit in the first wall niche is a controller cabinet. The drive unit and the controller cabinet are accessible from the landing via a maintenance door. The drive unit and the controller cabinet are arranged diagonally on the bottom floor, as a result of which the hoistway cross section can be optimally utilized.

5 Claims, 4 Drawing Sheets

ELEVATOR INSTALLATION WITH A DRIVE UNIT LOCATED IN AN ELEVATOR HOISTWAY

BACKGROUND OF THE INVENTION

1. Field of the Invention

The invention relates to an elevator installation with a drive unit which is located in an elevator hoistway and which drives an elevator car and counterweight by means of a suspension rope.

2. Discussion of the Prior Art

From patent application German reference DE 197 52 232 discloses an elevator installation in which the drive unit is located in the elevator hoistway adjacent to the travel path of the elevator car and adjacent to the travel path of the counterweight. Projecting into the elevator hoistway is a concrete base for the drive unit at the same height as, and formed monolithically with, a landing floor which allows space for the elevator car and the counterweight so that the elevator car and counterweight can move past the concrete base. The drive unit is arranged on the concrete base at an angle other than a right angle to an adjacent wall of the elevator hoistway. In the adjacent wall an access door to a control device is provided.

A disadvantage of the known device is that due to locating the drive unit on the adjacent wall, the free cross section for the elevator car is reduced. In a hoistway with a square cross section the usable horizontal area remaining for the elevator car is only a narrow rectangle.

SUMMARY OF THE INVENTION

Accordingly, it is an object of the present invention to provide an elevator installation that avoids the disadvantages of the prior art and to provide an arrangement of the hoistway equipment which optimally utilizes the cross section of the hoistway.

The advantages derived from the invention are essentially to be seen in that the arrangement of the drive unit in the hoistway cross section saves space. The only space in the hoistway cross section required by the drive unit is for the traction sheave. The arrangement of the counterweight creates free space at the side which cannot be used by the elevator car and in which space the drive unit is located. With the arrangement of the drive unit according to the invention, and by guiding the rope at a favorable angle between the traction sheave and the elevator car and counterweight respectively, it is also possible to avoid excessive lateral tension in the suspension rope guided over the traction sheave. A further advantage is that maintenance work on the drive unit, as well as manual operation of the elevator car for evacuations, are possible from the landing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

Figure 1:
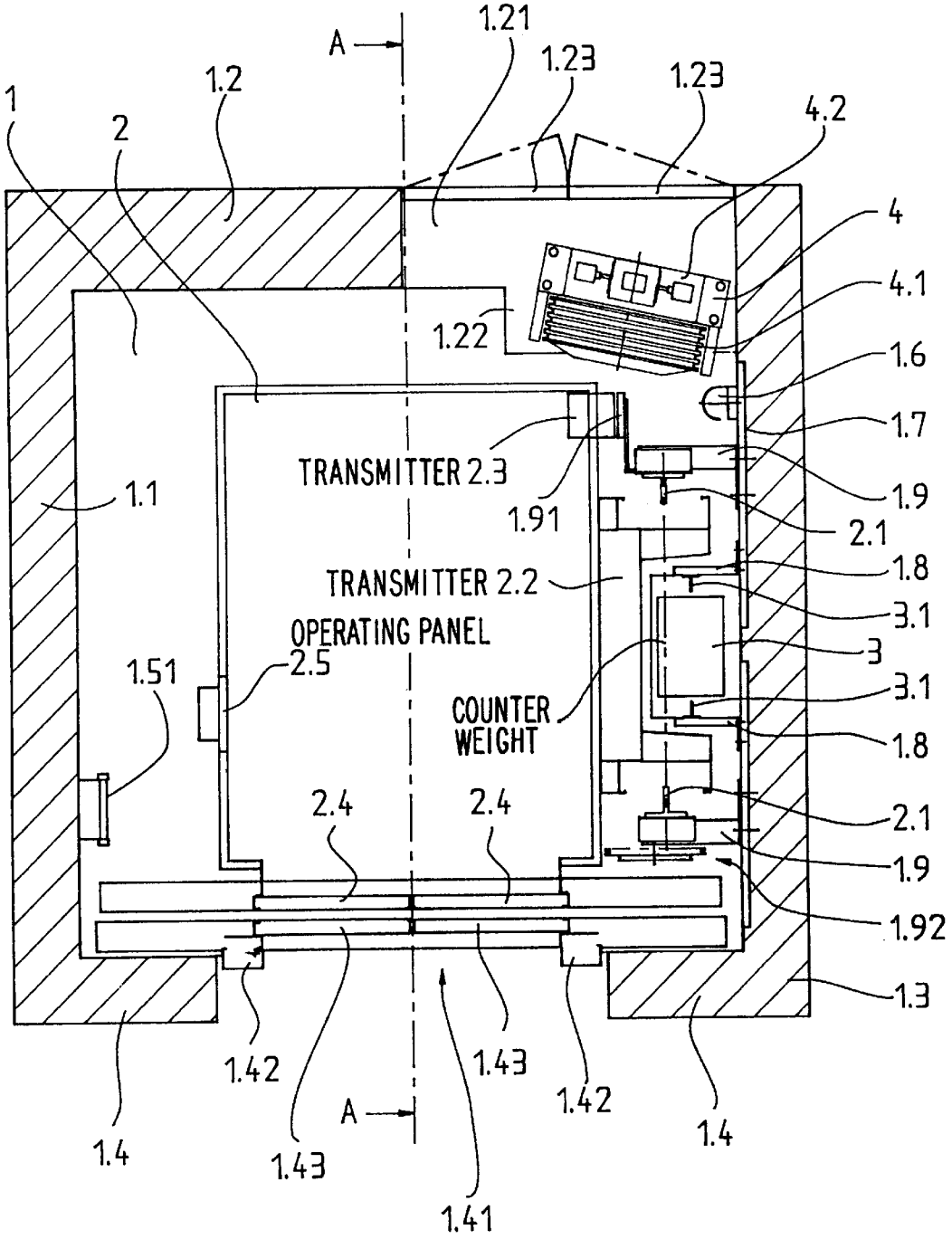
FIG. 1 is a horizontal section through an elevator hoistway with an elevator car, a counterweight, and a drive unit.

FIG. 1 shows a horizontal section through an elevator hoistway 1, in which an elevator car 2 with an operating panel 2.5, a counterweight 3, and a drive unit 4 standing diagonal to the adjacent hoistway wall are located. The elevator hoistway 1 is formed by a left-hand side wall 1.1, a rear wall 1.2, a right-hand side wall 1.3, a front wall 1.4, a hoistway pit 1.5, and a hoistway headroom which is not shown, a door opening 1.41 being provided in the front wall 1.4 on each floor 5. The door opening 1.41 is closed by means of a door architrave 1.42 and a hoistway door 1.43. The center opening hoistway door 1.43 is operable by means of a center opening car door 2.4. The hoistway is equipped with a hoistway pit ladder 1.51 for climbing into the hoistway pit 1.5, hoistway lighting 1.6, and anchor rails 1.7 fastened to the building and having attached to them first brackets 1.8 and second brackets 1.9. The first brackets 1.8 support counterweight guiderails 3.1 on which the counterweight 3 is guided along the height of the hoistway. The second brackets 1.9 support car guiderails 2.1 on which the elevator car 2 is guided over the height of the hoistway. In addition, fastened to the second brackets 1.9 are hoistway information transmitters 1.91 for monitoring the position of the car 2, and an overspeed governor 1.92 for monitoring the speed of the car 2. The hoistway information transmitters 1.91 of the elevator hoistway 1 function in conjunction with a hoistway information transmitter 2.3 of the elevator car 2.

FIG. 1 shows by way of example an elevator installation based on the rucksack principle having a laterally suspended elevator car 2. The elevator car 2 is supported by a car frame 2.2 which is guided on the car guiderails 2.1 and suspended on the suspension rope which is not shown. Not shown are the guide shoes and/or guide rollers of the car frame 2.2. The invention can also be used on an elevator installation with a centrally suspended elevator car.

The drive unit 4 is partially located in a first wall niche 1.21 and partly on a support 1.22, a traction sheave 4.1 of the drive unit 4 projecting into the elevator hoistway 1. Depending on the geometrical form of the drive unit 4, it can also be completely fastened in the wall niche 1.21. The support 1.22 transmits the machine forces and structurally borne noise into the pit floor of the hoistway pit 1.5. The elevator car 2 is connected to the counterweight 3 by means of the suspension rope which is guided over the traction sheave 4.1 and over the deflector sheaves which are located in the hoistway headroom. In the example shown, the deflector sheaves 2.8 and 2.9 for the elevator car 2 are shown. The ropes pass from the traction sheave 4.1 upward to separate deflector sheaves for the counterweight and the for the elevator car 2 and from there pass downward again, the rope ends being fastened to the counterweight and the elevator car 2. Instead of the supporting base there can also be brackets or angle sections on the rear wall 1.2. Located above the drive unit 4 in the first wall niche 1.21 is a controller cabinet 6. The drive unit 4 and the controller cabinet 6 are accessible from the landing 5 via a maintenance door 1.23.

In the embodiment shown, the drive unit 4 and the controller cabinet 6 are located diagonally on the bottom floor 5. Location of the drive unit 4 and the controller cabinet 6 of the elevator unit on other floors of the elevator installation is also conceivable.

With the arrangement according to the invention, manual evacuation of elevator users trapped in the elevator car 2 is possible from the landing 5. After opening the maintenance door 1.23, a brake 4.2 of the drive unit 4 which is positioned at an angle in the corner of the elevator hoistway 1, and a mountable handwheel 4.3, can be operated and the elevator car 2 moved upward or downward to the next floor depending on the load.

Figure 2:
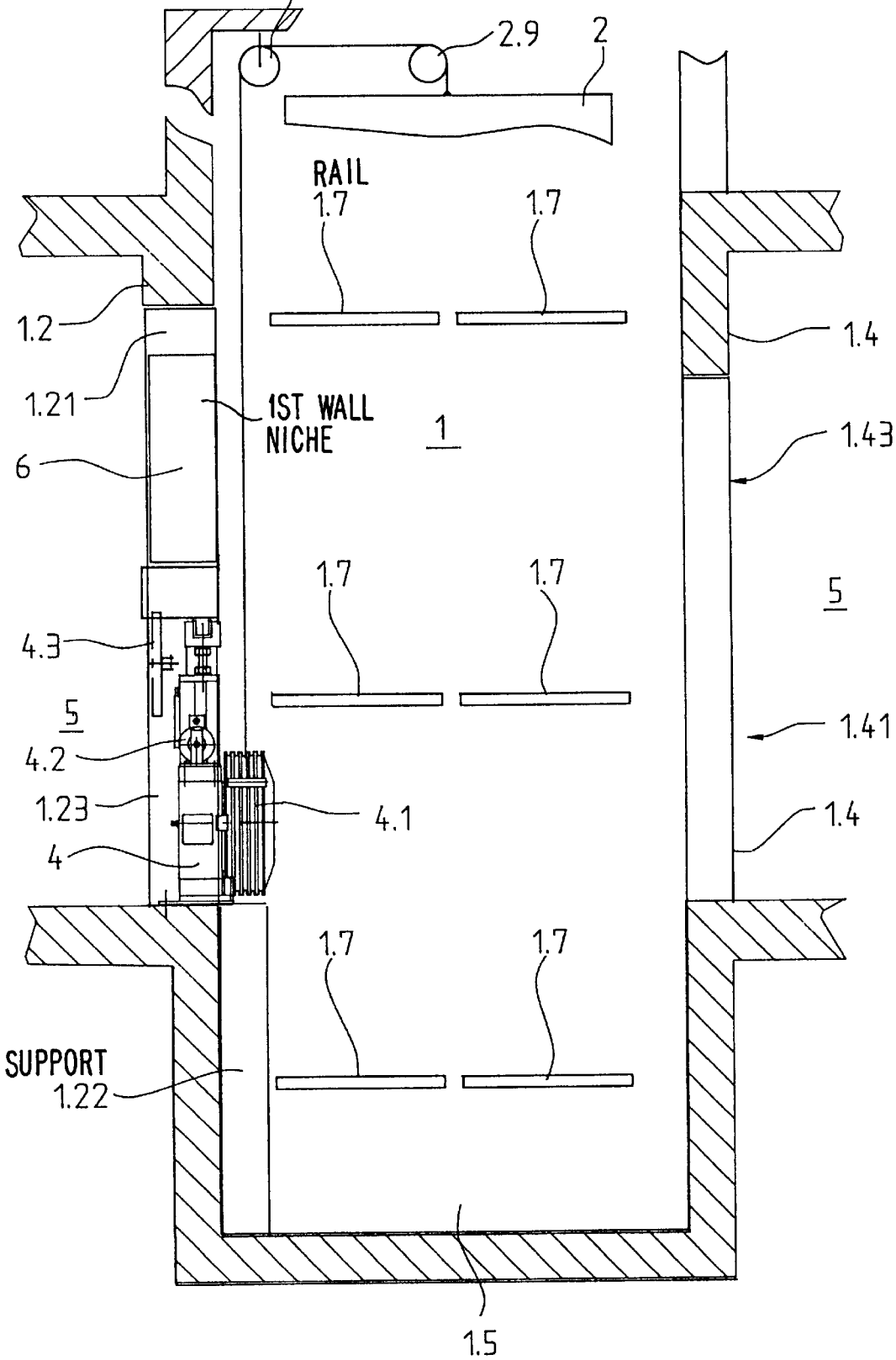
FIG. 2 is a cross-section along the line A—A of FIG. 1.

FIG. 2 shows the cross section along the line A—A of FIG. 1 with the drive unit 4 arranged diagonally on the floor 5. The compactly constructed drive unit 4 may or may not be fitted with gears. The handwheel 4.3 is in a holder from which it is removed when required and mounted on the drive unit 4.

Figure 3:
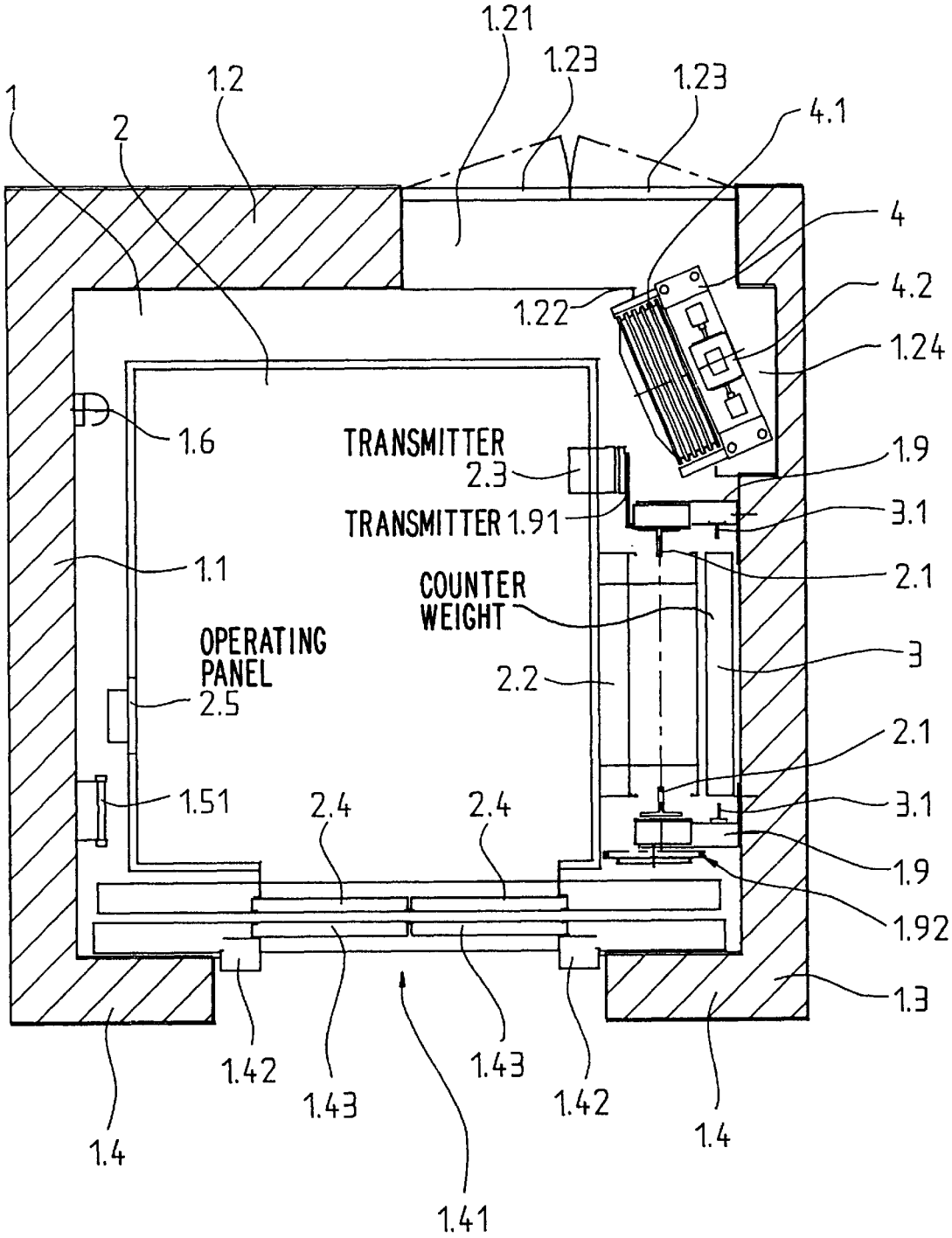
FIG. 3 shows a further embodiment of the arrangement of the drive unit according to the invention.

FIG. 3 shows a further embodiment in which the drive unit 4 is arranged diagonally on the bottom floor 5 partly in the first wall niche 1.21 and partly in a second wall niche 1.24 in the right-hand side wall 1.3. With this variant, elevator installations with elevator cars 2 of greater depth can be implemented. Furthermore, due to the favorable angle at which the rope is guided between the traction sheave and the elevator car 2 and the counterweight 3 respectively, there is little occurrence of lateral tension in the suspension rope which is guided over the traction sheave.

Figure 4:
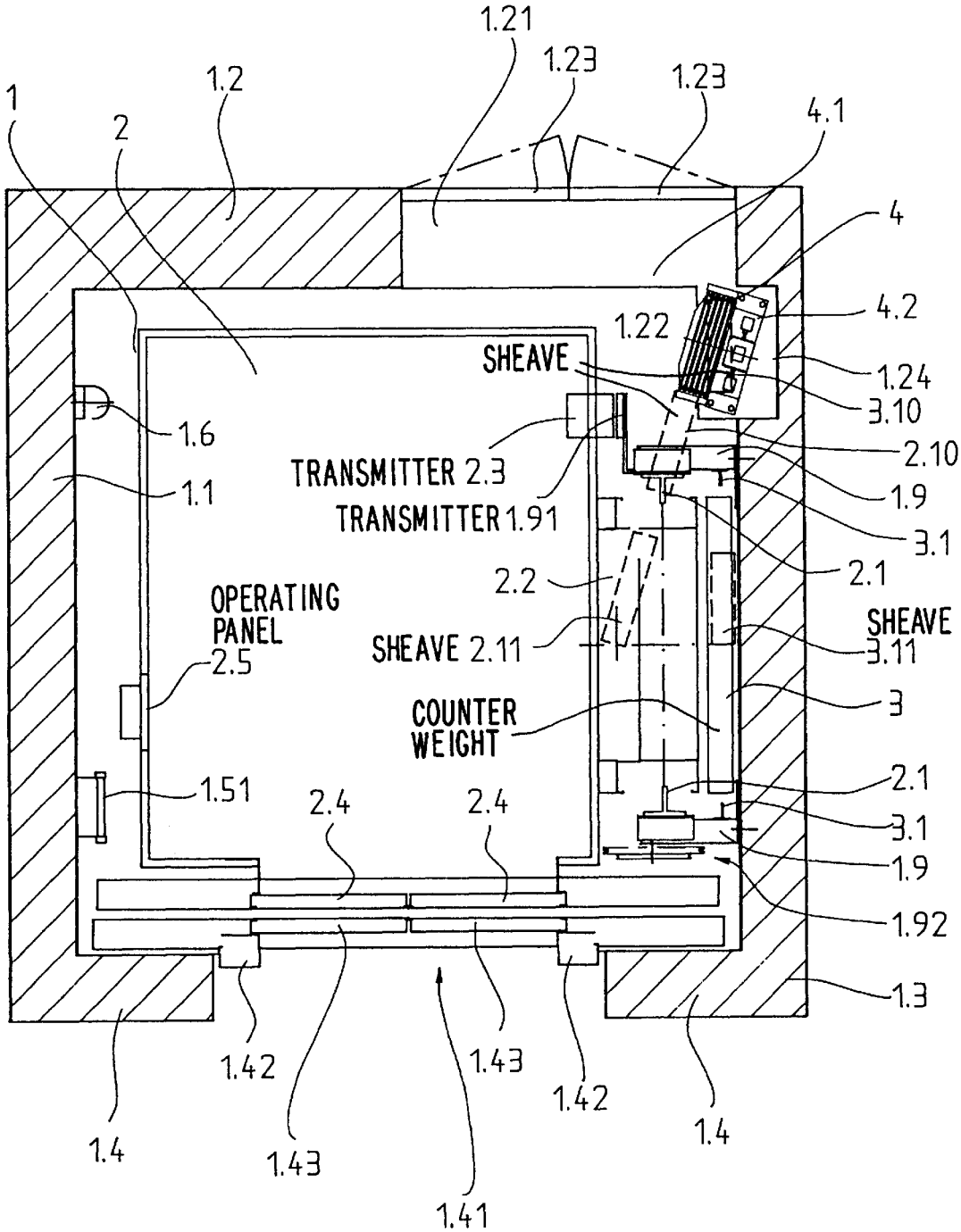
FIG. 4 shows a further embodiment with deflector sheaves as shown.

FIG. 4 shows the position of the deflector sheaves 2.10, 2.11 for the elevator car 2 and the position of the deflector sheaves 3.10, 3.11 for the counterweight 3. The longitudinal axis of the deflector sheaves 2.10, 2.11 and the longitudinal axis of the deflector sheaves 3.10, 3.11 form an acute angle, by means of which an excessive fleet angle in the suspension rope guided over the traction sheave and the deflector sheaves 2.10, 2.11, 3.10 ,3.11 can be avoided.

A roping arrangement with central suspension of the elevator car 2 or a roping arrangement with the underslung elevator car 2 is also possible.

The invention is not limited by the embodiments described above which are presented as examples only but can be modified in various ways within the scope of protection defined by the appended patent claims.

I claim:

1. An elevator installation, comprising: an elevator car; an elevator hoistway; a drive unit which is located in the elevator hoistway and operative to drive the elevator car by means of a suspension rope; and a counterweight, the drive unit being arranged at an angle in a corner of the elevator hoistway.

2. An elevator installation according to claim 1, wherein the drive unit is partially arranged in a niche in a wall of the hoistway, the drive unit including a traction sheave that projects into the elevator hoistway.

3. An elevator installation according to claim 1, and further comprising a controller cabinet located above the drive unit, the controller cabinet and the drive unit being accessible via a maintenance door in the hoistway.

4. An elevator installation according to claim 3, wherein the controller cabinet and the drive unit are located on a bottom floor of the elevator installation.

5. An elevator installation according to claim 1, wherein the elevator hoistway has a front wall in which a doorway is arranged, and a rear wall opposite the front wall and connected to the front wall by sidewalls, the drive unit being arranged in the corner of the hoistway formed between the rear wall and one of the sidewalls.

* * * * *